United States Patent [19]

Kitchens

[11] Patent Number: 4,976,323

[45] Date of Patent: Dec. 11, 1990

[54] COUNTERBORING DEVICE FOR WELLS

[76] Inventor: Richard A. Kitchens, 1617 S. Highway 85, Fayetteville, Ga. 30214

[21] Appl. No.: 373,405

[22] Filed: Jun. 30, 1989

[51] Int. Cl.[5] ..... E21B 10/32

[52] U.S. Cl. ..... 175/267

[58] Field of Search ..... 175/263, 265, 267, 292

[56] References Cited

U.S. PATENT DOCUMENTS

| | | | |
|---|---|---|---|
| 3,799,276 | 3/1974 | Matsushita et al. | 175/267 X |
| 4,589,504 | 5/1986 | Simpson | 175/267 |
| 4,809,793 | 5/1989 | Hailey | 175/265 |

*Primary Examiner*—William P. Neuder

*Attorney, Agent, or Firm*—James B. Middleton

[57] ABSTRACT

A drill extension is inserted between the drill rod and the drill bit, the drill extension having extendible cutting devices to counterbore the hole drilled by the drill bit for receiving a casing. The cutting devices are flush with the outer surface of the drill extension when not in use, and are pivoted to be expanded by centrifugal force and water pressure when in use. The counterbore is sized to receive the outside diameter of the well casing; and, the cutting devices are retracted to pass up through the casing.

3 Claims, 1 Drawing Sheet

10
16
18
21
24
22
26
19
20
14
25
28
29
12
11
15
2
34
32
30
31

COUNTERBORING DEVICE FOR WELLS

INFORMATION DISCLOSURE STATEMENT

It is common practice in drilling some forms of wells to drill a hole of some depth, then to sink a casing into the hole before drilling further. The provision of a casing is generally necessary to support the walls of the hole and to prevent either total collapse or some shedding of debris from the wall of the well into the hole. The provision of a casing, and subsequently the advancing of the casing, is somewhat difficult in that a drill has drilled a hole of one size, while the outside diameter of the casing is of a larger size. To counterbore the well for receiving the casing, then, the counterboring device must pass through the casing, do the counterboring, then collapse for withdrawal through the casing.

In drills of the type utilized for drilling oil wells, which frequently drill through rock and the like, the drill string is quite complex, so apparatus used in an oil well can be complex and still be commercially useful. When such complexity of drilling apparatus is allowed, one can devise numerous forms of expandable drilling apparatus that can be expanded to drill, or counterbore, a large hole, then be retracted to be withdrawn from the hole.

In the drilling of wells as in test boring, and monitoring wells, wherein the wells are primarily drilled through only dirt, clay, sand and the like, the drilling apparatus is relatively simple, and the industry will not tolerate the use of the elaborate mechanisms for drilling through rock. Thus, the casings in test borings and in monitoring wells are usually provided by simply driving the casing into the hole after a hole has been drilled. While the casing may be relatively easy to drive when the earth is predominantly sand or other soft material, it will be realized that the casing is extremely difficult to drive when the earth is a sticky clay or similar substance.

SUMMARY OF THE INVENTION

This invention relates generally to well drills and the like, and is more particularly concerned with a counterboring device for use with well drills.

The present invention provides, in conjunction with a drill bit, a drill extension having retractable cutting devices therein. The drill extension may fit between the drill bit and the drill rod, and the cutting means lie in a retracted position and are extended by fluid pressure and/or centrifugal force, so no elaborate mechanisms are required. In the preferred embodiment of the invention, the cutting devices extend outwardly sufficiently to provide a counterbore of the correct size for receiving the casing. When the counterboring has been completed, the cutting devices can be retracted and the entire drill string can be withdrawn through the casing.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figures 1, 2, 3:
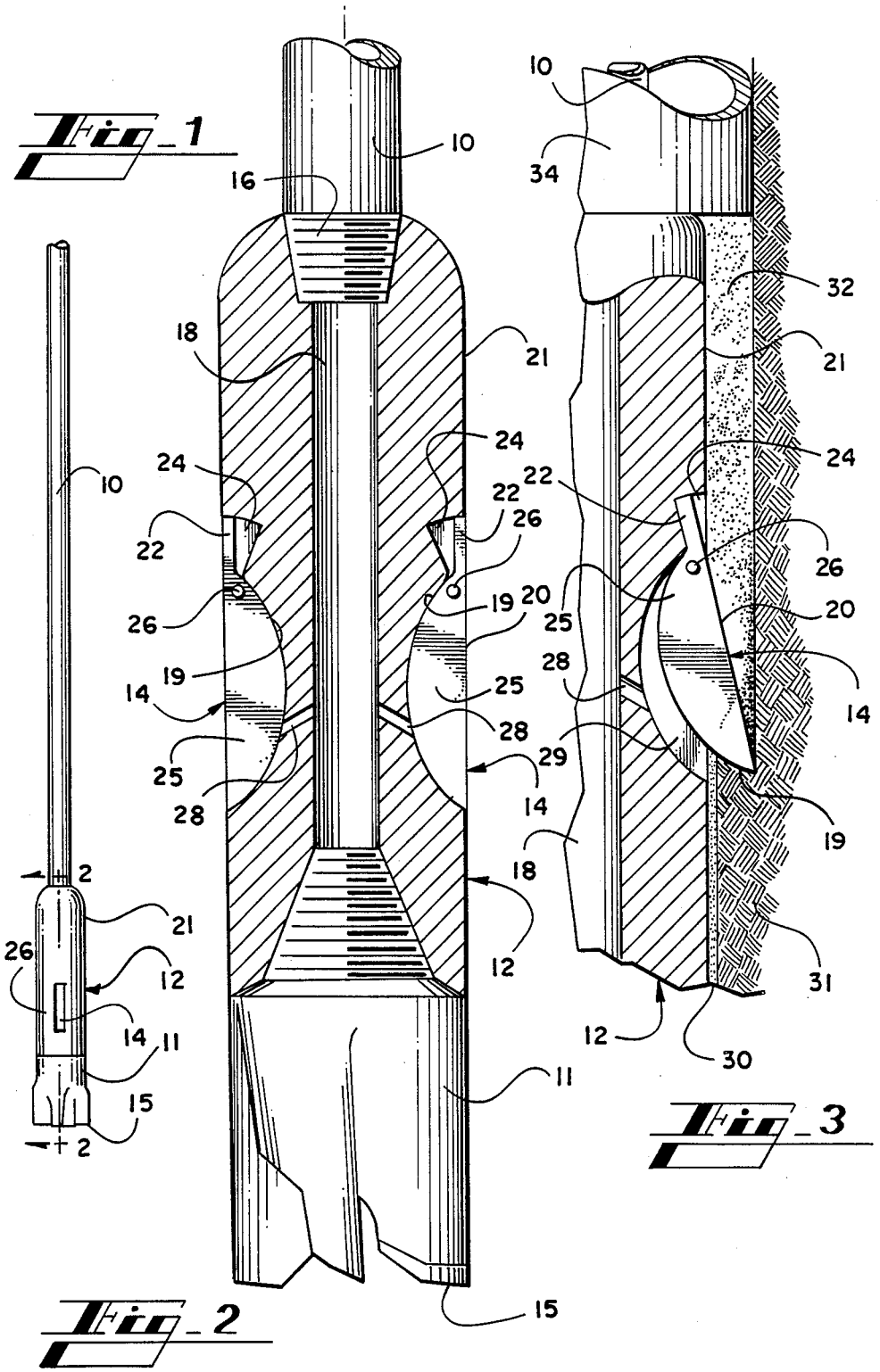
FIG. 1 is a side elevational view of a portion of a drill string, and showing the counterboring device of the present invention thereon.
FIG. 2 is an enlarged, cross-sectional view taken substantially along line 2—2 in FIG. 1; and, FIG. 3 a fragmentary view showing one of the cutting means in its extended position.

Referring now more particularly to the drawings, and to that embodiment of the invention here presented by way of illustration, FIG. 1 shows a drill rod 10, having a drill bit 11 at the lowermost end thereof. The drill bit 11 here shown as a simple drag bit, but those skilled in the art will understand that the drag bit is shown by way of illustration, and numerous other forms of drill bits, including rotary bits, may be substituted for the bit 11 shown.

The drill extension 12 made in accordance with the present invention is carried at the end of the drill rod 10, and mounts the drill bit 11 at its lower end. It will be noted in FIG. 1 of the drawings that the cutting device 14 is retracted within the drill extension 12, and the drill extension 12 is of a slightly less diameter than the cutting tip 15 of the bit 11.

Looking at FIG. 2 in conjunction with FIG. 1, it will be seen that the drill rod 10 is in the form of a pipe, having threads 16 received in complementary threads in the drill extension 14. The drill rod 10 is usually a pipe because cooling liquid is passed through the pipe to cool the drill bit and to assist in removing dirt and debris from the hole being drilled. Thus, the drill extension 14 is provided with a central passageway 18 in communication with the central opening in the pipe 10. This passageway 18 extends to the drill bit 11 which will be provided with conventional cooling passages. The cooling arrangement in the drill bit 11 is not shown since it forms no part of the present invention, and it will be well understood by those skilled in the art.

The drill extension 12 is here shown as including two cutting devices 14. Both cutting devices 14 are alike, and apparatus made in accordance with the present invention may have more than two such devices if desired. It will be understood that a plurality of cutting devices 14 will be distributed substantially equidistantly around the circumference of the drill extension 12. Each cutting device 14 will be alike, and only one cutting device 14 will be described in detail, and the same parts on other cutting devices will carry the same reference numerals.

In FIG. 1 it will be noted that the cutting device 14 is substantially rectangular. In FIG. 2, the side of the cutting device 14 is shown, and it will be noted that the device has an arcuate inner surface 19 and a straight outer surface 20, the outer surface 20 being precisely aligned with the outer surface 21 of the drill extension 12. At the upper end of the cutting device 14 there is a lip 22 in a notch 24. Between the body 25 (which is bounded by the arcuate surface 19 and the straight surface 20) and the lip 22, there is a pivot pin 26. Looking again at FIG. 1 of the drawings, it will be noted that the pin 26 extends along a secant of the circular drill extension 12 so that the cutting device 14 is pivotal about the pin 26.

There is a fluid passage 28 connecting the central passageway 18 with the cavity 29 which receives the body 25 of the cutting device 14.

With the above discussion in mind, it should be understood that the cutting device 14 will normally take the position shown in FIGS. 1 and 2 of the drawings, the outer surface 20 of the cutting device 14 being precisely aligned with the outer surface 21 of the drill extension 12. The configuration of the cutting device 14 is such that the body 25 can move outwardly, pivoting about the pivot 26, and the lip 22 will move inwardly, into the notch 24. When the lip 22 engages the innermost edge of the notch 24, outward movement of the body 25 will be stopped.

It is contemplated that the liquid passing through the central passageway 18 will pass through the passageway 28 and assist in urging the body 25 from the cavity 29. This will be in conjunction with the centrifugal force generated by the drilling motion. The combination of forces should be sufficient to urge the cutting device 14 into its maximum, outwardly disposed, cutting position.

Attention is next directed to FIG. 3 of the drawings which shows a portion of a hole drilled in earth, and shows the counterbore provided by the cutting devices 14. At the lower end of FIG. 3, it will be seen that the drill extension 12 is within a hole 30 drilled by the drill bit 11. As is conventional, the drill bit 11 is slightly larger than the drill string that follows, so there is a very small distance between the earth 31 and the drill extension 12. In the upper portion of the figure, the counterbore is designated at 32, the counterbore being sufficient to receive the casing indicated at 34.

It will be observed that the cutting device 14 is in its outermost position, and is cutting the earth 31 for providing the counterbore 32. Since the drill extension 12 will be rotating, and urged downwardly, it will be understood that the arcuate rear surface 19 of the cutting device 14 will act somewhat as a wedge in the earth 31 so the earth will also tend to urge the body 25 outwardly. Centrifugal force and the force of the liquid passing through the passageway 28 will cause the initial outward movement of the body 25, and will assist in sustaining the outward position during the drilling.

Once the hole has been drilled to the desired extent, and counterbored to receive the casing 34, rotational movement of the drill string will stop so centrifugal force will no longer hold the body 25 out. Further, the cooling fluid will be terminated, so the fluid force will no longer hold the body 25 out. With the body 25 wedged into the earth as illustrated in FIG. 3, the body 25 will not readily retract; however, it will be understood that, on upward movement of the drill string, carrying the drill extension 12 therewith, the body 25 will naturally move inwardly, eventually urged somewhat by the casing 34.

It will therefore be understood that the present invention provides an extremely simple counterboring device for use with the simple and uncomplicated drill strings used in drilling test bores, monitoring wells and the like. The use of cooling fluid to assist in holding the cutting devices outwardly will of course also assist in preventing build-up on the cutting device in the event the earth 31 is sticky as in clays and such. The normal position of the cutting devices is retracted. The device will therefore easily pass through the casing so the device can be removed before the casing is urged further into the well.

It will therefore be realized that the present invention provides means for allowing a casing in a well to be advanced without the necessity for drilling the well with a larger bit, necessitating a larger casing. In drilling a test bore, the hole can be stopped at any point, the counterboring device inserted, and removed before the casing is progressed. For monitoring wells and the like, the counterbore can allow the casing to progress, and the device can be removed through the casing to allow further drilling or other activity as required.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined the appended claims.

I claim:

1. In a drilling apparatus for drilling monitoring wells, wherein said drilling apparatus includes a drill bit, a drill rod for carrying and for rotating said drill bit, and a drill extension for connecting said drill rod to said drill bit, said drill rod defining a coolant passage therethrough, said drill extension defining a central passageway in communication with said coolant passage, the improvement wherein said drill extension includes at least one cutting device, said cutting device including a body pivotally carried by said drill extension, said drill extension defining at least one cavity therein for selectively receiving said body freely pivoted therein between a fully contracted and a fully extended position, said cavity having a size and shape just to receive said body, said drill extension further defining a passage between said central passageway and said cavity, and means for limiting the outward movement of said body to define the fully extended position, the arrangement being such that said cavity normally receives said body, and said body is pivoted outwardly therefrom to a cutting position by centrifugal force on rotation of said drill extension by said drill rod, and some of the coolant flowing through said coolant passage and into said central passageway is divered through said passage between said central passageway and said cavity for assisting in causing outward pivotal motion of said body.

2. In a drilling apparatus as claimed in claim 1, the further improvement wherein said cutting device includes a lip carried by said body and pivotal therewith, a pin extending transversely of said cutting device for pivotally connecting said cutting device to said drill extension, said body being substantially below said pin, and said lip being above said pin, said drill extension defining a notch therein for selectively receiving said lip on pivotal motion of said cutting device, the arrangement being such that said body pivots outwardly and said lips pivots inwardly, the inner surface of said notch constituting said means for limiting the outward movement of said at least one cutting device.

3. In a drilling apparatus as claimed in claim 2, said cutting device having an arcuate inner surface and a straight outer surface, said outer surface of said cutting device being coplanar with the outer surface of said drill extension when said body is fully received within said cavity.

* * * * *